United States Patent [19]

Haines

[11] 4,371,080

[45] Feb. 1, 1983

[54] CHILDPROOF PACKAGE FOR MULTIPLE PRODUCTS

[75] Inventor: Russell R. Haines, Brielle, N.J.

[73] Assignee: Paco Packaging Incorporated, Lakewood, N.J.

[21] Appl. No.: 236,420

[22] Filed: Feb. 20, 1981

[51] Int. Cl.[3] ..... B65D 83/04; B65D 85/42

[52] U.S. Cl. ..... 206/531; 206/532; 206/538; 206/533

[58] Field of Search ..... 206/530, 531, 532, 538, 206/539, 533; 424/21; 220/8

[56] References Cited

U.S. PATENT DOCUMENTS 4,158,411 6/1979 Hall ..... 206/531

*Primary Examiner*—Joseph Man-Fu Moy

*Attorney, Agent, or Firm*—Seidel, Gonda, Goldhammer & Panitch

[57] ABSTRACT

A childproof package has multiple pharmaceutical products in spaced relation within a receptacle. An open side of the receptacle is closed by a tough closure layer sealed to a flange on the receptacle. The receptacle includes a wall which facilitates moving one of the products toward the other until they are sufficiently juxtaposed whereby the products cooperate to apply a combined force sufficient to rupture the closure layer as the package is bent along an imaginary transverse line.

9 Claims, 5 Drawing Figures

FIG. 1
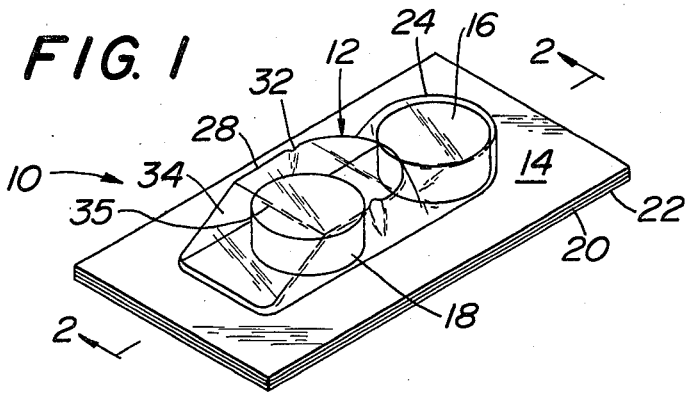
FIG. 2
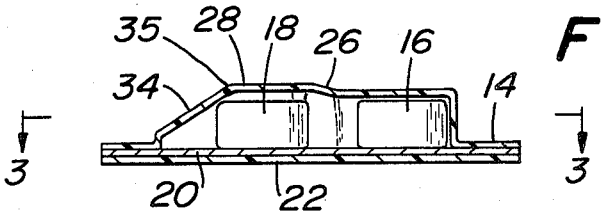
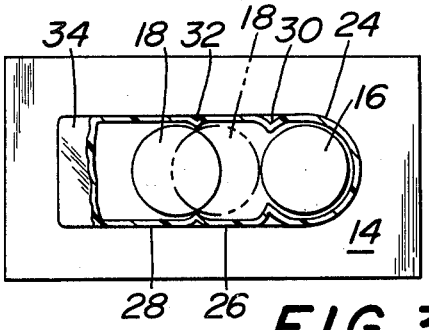
FIG. 3
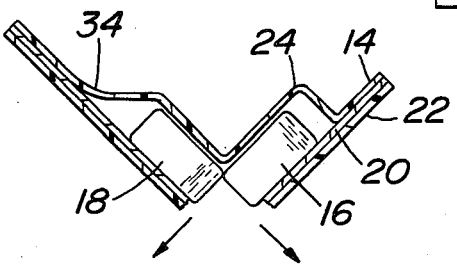
FIG. 4
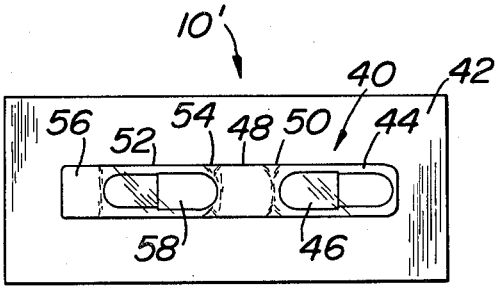
FIG. 5

CHILDPROOF PACKAGE FOR MULTIPLE PRODUCTS

BACKGROUND

It is old in the art to provide packages containing multiple pharmaceutical products. See U.S. Pat. No. 3,207,299 which teaches a package construction to facilitate easy access to the contents of the package. Recently enacted regulations require pharmaceutical products to be sold in a childproof package. A childproof package should not provide easy access to the contents of the package.

The present invention is directed to a solution of the problem of providing a package which is childproof and yet provides for easy access to products therein by adults.

SUMMARY OF THE INVENTION

The present invention is directed to a childproof package for multiple pharmaceutical products. The package includes a receptacle having an open side and containing two pharmaceutical products in remote spaced relation. The receptacle has an outwardly extending flange adjacent the open side. A tough closure layer is sealed to the flange and closing the open side of the receptacle.

The closure layer and the receptacle are free from any slit or weakened portion provided to facilitate access to the products. A means is provided on the receptacle for moving one of the products toward the other until they are sufficiently juxtaposed whereby the products cooperate to apply a combined force sufficient to rupture the closure layer as the package is bent about an imaginary transverse line located between the juxtaposed ends of the products.

It is an object of the present invention to provide a childproof package for multiple pharmaceutical products.

It is another object of the present invention to provide a childproof package for multiple pharmaceutical products which is simple, inexpensive, and is free from any slits or weakened portions provided to facilitate access to the products.

It is another object of the present to provide a childproof package for multiple pharmaceutical products which is simple, inexpensive, and reliable in preventing access by children while at the same time providing easy access by adults.

Other objects and advantages will appear hereinafter.

For the purpose of illustration the invention, there is shown in the drawing a form which is presently preferred; it being understood, however, that this invention is not limited to the precise arrangements and instrumentalities shown.

FIG. 1 is a perspective view of a package in accordance with the present invention.

FIG. 2 is a sectional taken along the line 2—2 in FIG. 1.

FIG. 3 is a sectional view taken along the line 3—3 in FIG. 2.

FIG. 4 is a sectional view illustrating the package in an opened condition whereby there is access to the pharmaceutical products.

FIG. 5 is a plan view of another package in accordance with the present invention.

DETAILED DESCRIPTION

Referring to the drawing in detail, wherein like numerals indicate like elements, there is shown in FIG. 1 a childproof package in accordance with the present invention and designated generally as 10. The package 10 is designed to provide easy access to multiple pharmaceutical products by adults while complying with childproof regulations.

The package 10 includes a receptacle designated generally as 12 and preferably made from a transparent plastic material. The receptacle 12 is open on one side. Adjacent the open side the receptacle has an outwardly extending planar flange 14 which is of rectangular configuration. The receptacle 12 and its flange 14 are integral in one piece and may be made from a wide variety of plastic materials capable of being vacuum formed such as polyvinylchloride having a thickness of 0.007 to 0.015 inches. A polymeric plastic of this type and thickness exhibits sufficient toughness whereby a child cannot attain access to the interior of the receptacle 12 by biting or twisting the receptacle. At the same time the receptacle 12 is sufficiently flexible to facilitate flexing or deforming the walls thereof as referred to hereinafter.

The receptacle 12 is sufficiently large, as will be described hereinafter, to contain two pharmaceutical products such as pills 16 and 18. The open side of the receptacle 12 may be hermetically sealed by a moisture barrier such as aluminum foil layer 20 bonded to the flange 14 on one side and bonded to a closure layer 22 on the other side. The closure layer 22 is preferably a tough polymeric plastic material such as MYLAR or a polyester which is sufficiently tough so as to prevent the child from biting through the layer 22. Layer 22 may have a thickness of 0.0005 to 0.001 inches.

The receptacle 12 is divided into three compartments delineated by pairs of creases that form detents. A first end compartment 24 contains the pill 16. A second or middle compartment 26 is delineated from the compartment 24 by the detent 30. A second end compartment 28 is delineated from the compartment 26 by the deformable detent 32. The compartments are in direct communication with one another. Pill 18 is disposed within the compartment 28. An end wall 34 of compartment 28 is at an acute angle (30° to 60°) which preferably is about 45° with respect to the planar flange 14. About ¼ of pill 18 is to the left of intersection 35 between wall 34 and the receptacle top wall. See FIG. 2.

The pills 16 and 18 are introduced into the respective compartments 24 and 28 so as to be in remote spaced relationship. If one attempts to bend the package 10 about a transverse imaginary line across the compartment 26, it is not possible to attain access to the pills 16 and 18 since the receptacle compartment 26 will merely deform inwardly. There are no tear strips, slits, or weakened portions to provide access to the pills 16, 18.

When it is desired to attain access to the pills 16, 18, finger pressure is applied to flex wall 34 inwardly to move the pill 18 from the solid line position in FIG. 3 to the phantom position in FIG. 3. In doing so, the pill 18 moves past the detent 32 which only temporarily retains pill 18 in compartment 28. At this point, the pills 16 and 18 are juxtaposed to one another. When the package 10 is bent about a transverse imaginary line located between the juxtaposed ends of the pills 16 and 18, the pills cooperate with each other at their upper corners to prevent compartment 26 from collapsing while at the same time the lower corners of the pills 16 and 18 exert outward forces in the direction of the arrows in FIG. 4 to rupture the closure layer 22 transversely at said imaginary line to thereby facilitate easy access to the pills 16, 18.

The package 10 is rendered childproof since there is only one way to obtain access to the pills and requires at least two minipulative steps in sequence. Thus, one pill must be moved toward the other pill until they are juxtaposed and thereafter, the package must be bent about an imaginary transverse line located between the juxtaposed ends of the products to the position shown in FIG. 4. Since there are no slits, tear strips, or weakened portions, there are no clues to lead a child to perform the two manipulative steps in the exact sequence described above.

In designing the childproof package of the present invention, it will be apparent to those skilled in the art that it has been accomplished in a simple and inexpensive manner. Thus, only minor changes are needed with respect to the shape of the molds for vacuum forming the receptacle 12 so as to have two sets of detents delineating the receptacle 12 into three compartments. The detents 30 are more severe and constitute permanent detents while detents 32 are readily deformable when finger pressure of an adult is applied to the pill 18 by way of the angled end wall 34.

The foil layer 20 provides the package 10 with an attractive appearance since it is visible through the transparent flange 14. If the products do not require a hermetic seal, then foil layer 20 may be eliminated with closure layer 20 being bonded directly to flange 14. If desired, a paper layer may be bonded to layer 22 for receiving any printed messages such as instructions, trademark, etc.

The present invention is equally applicable to other types of pharmaceutical products in addition to pills. In FIG. 5, there is shown a top plan view of another embodiment of the present invention wherein the pharmaceutical products are capsules. The package 10' includes a receptacle 40 having a flange 42. The receptacle 40 is divided into a first end compartment 44 containing a capsule 46. The receptacle 40 includes a middle compartment 48 separated from compartment 44 by way of the permanent detent 50. The receptacle 40 includes a second end compartment 52 separated from the compartment 48 by a deformable detent 54 and containing a second capsule 58. The end wall 56 of compartment 52 is angled as described above. Package 10' is otherwise identical with package 10.

The simple change to the shape of the receptacle eliminates the need for special machinery and/or processing of the packages which are normally associated with packages having slits, perforation lines, and other weakened portions designed to facilitate access to the product by an adult. The present invention requires two steps in an exact sequence in order to obtain easy access to the pharmaceutical products by an adult while at the same time complying with statutory requirements for childproof packages.

The present invention may be embodied in other specific forms without departing from the spirit or essential attributes thereof and, accordingly, reference should be made to the appended claims, rather than to the foregoing specification, as indicating the scope of the invention.

I claim:

1. A childproof package for plural products comprising a receptacle having an open side, said receptacle containing two products in remote spaced relation, said receptacle having an outwardly extending flange adjacent the open side, a tough closure layer sealed to said flange and closing said open side of said receptacle, said closure layer and receptacle being free from any slit or weakened portion provided to facilitate access to said products, means on the receptacle for moving one of the products therein toward the other product until they are sufficiently juxtaposed whereby the products cooperate to apply a combined force sufficient to rupture said closure layer as the package is bent about an imaginary transverse line located between the juxtaposed ends of the products.

2. A package in accordance with claim 1 wherein the flange is planar, said means including an end wall of said receptacle, said end wall being disposed at an acute angle with respect to the flange.

3. A package in accordance with claim 2 wherein said means includes a detent means on the receptacle for temporarily retaining said one product in said remote spaced relation with respect to the other product until force is applied to said end wall to enable said one product to move past the detent means toward the other product to said juxtaposed position of the products.

4. A package in accordance with claim 1 wherein said products are selected from the group consisting of pills and capsules.

5. A childproof package for pharmaceutical products comprising a receptacle having an open side and an outwardly extending flange adjacent thereto, a tough closure layer sealed to said flange and closing said open side of said receptacle, said receptacle having first and second end compartments, spaced from one another by an intermediate compartment, a pharmaceutical product in each of said end compartments, means on the receptacle for moving one of the products from its end compartment into the intermediate compartment so that the products are sufficiently juxtaposed whereby they cooperate to apply a combined force sufficient to rupture said closure layer as the package is bent about an imaginary transverse line located between the juxtaposed ends of the products.

6. A package in accordance with claim 5 wherein said means includes an end wall on one of said end compartments, said end wall being at an acute angle with respect to said flange.

7. A package in accordance with claim 6 wherein said means includes detent means on the receptacle for delineating the end compartment containing said one product with respect to the intermediate compartment for temporarily retaining said one product in said one end compartment until force is applied to said end wall to move said one product passed said detent means into said intermediate compartment.

8. A package in accordance with claim 7 wherein said detent means includes a crease on a side wall of said receptacle.

9. A package in accordance with claim 5 wherein said intermediate compartment is sufficiently large whereby the receptacle walls defining said intermediate compartment can deform inwardly as the package is bent about said line when said products are in said end compartments.

* * * * *